US005783501A

United States Patent [19]

Schuetze et al.

[11] Patent Number: 5,783,501

[45] Date of Patent: Jul. 21, 1998

[54] PAPER MACHINE FELTS

[75] Inventors: Gustav Schuetze, Domat/Ems; Jürgen Spindler, Domat7Ems, both of Germany

[73] Assignee: EMS-Inventa AG, Zurich, Switzerland

[21] Appl. No.: 505,206

[22] PCT Filed: Oct. 10, 1994

[86] PCT No.: PCT/EP94/03337

§ 371 Date: Aug. 14, 1995

§ 102(e) Date: Aug. 14, 1995

[87] PCT Pub. No.: WO95/16810

PCT Pub. Date: Jun. 22, 1995

[30] Foreign Application Priority Data

Dec. 16, 1993 [DE] Germany ..... 43 43 067.8
Sep. 29, 1994 [DE] Germany ..... 44 34 898.3

[51] Int. Cl.[6] ..... D21F 7/08

[52] U.S. Cl. ..... 442/57; 442/58; 442/193; 442/199; 442/200; 442/201; 162/358; 162/900; 162/907

[58] Field of Search ..... 264/101, 137, 264/236; 427/350, 372.2; 428/234, 200; 162/358, 900, 902; 442/57, 58, 270, 193, 199, 200, 201

[56] References Cited

FOREIGN PATENT DOCUMENTS 287297 10/1988 European Pat. Off. ..... D21F 7/08
474027 3/1992 European Pat. Off. ..... D01F 11/08
529506 3/1993 European Pat. Off. ..... D21F 7/08

*Primary Examiner*—Rich Weisberger
*Attorney, Agent, or Firm*—Frost & Jacobs

[57] ABSTRACT

The invention relates to postcondensed paper machine felts comprising a polyamide base fabric and a polyamide coating needled thereon, the paper machine felts having a relative solution viscosity in sulfuric acid in accordance with the DIN 53,727 standard of 5 or more.

The invention further relates to a method of increasing the molecular weight of paper machine felts which comprises impregnating the paper machine felts with a solution of postcondensation catalysts, followed by drying and thermally postcondensing the felts below the melting point of the polyamide in a solid phase by the exclusion of oxygen.

14 Claims, 2 Drawing Sheets

FIG. 2a PRESSURE TEST

PRESSURE TEST WITH HIGH PRESSURE SHOWER

ABRASION TEST WITH CERAMIC BARS

PAPER MACHINE FELTS

BACKGROUND OF THE INVENTION

The invention relates in particular to postcondensed paper machine felts comprising a polyamide base fabric and a polyamide coating needled thereon.

The invention further relates to a method of increasing the molecular weight of the aforementioned paper machine felts.

Paper machine felts generally comprise a base fabric on which preneedled web material has been needled. Basically, it is also possible to use spunbonded webs in place of dried web materials.

DE-A-4,027,063 discloses a process for preparing particularly high-weight polyamide fibers by postcondensation. Such postcondensed fibers have the drawback of poor processability because they are very rigid due to their high molecular weight.

Therefore, more energy is needed for carding and needling, and this increased energy enhances the risk of fiber damage during processing.

Another factor to be considered is that postcondensed fibers in the felt can hardly be heat set, that is to say that tension that builds up in the fiber during processing cannot be fully eliminated. This promotes fiber shedding, that is the removal of major fiber fragments or even entire fibers from the felt.

In addition, postcondensed fibers exhibit virtually no thermal shrinkage. The felts are no longer precompressed during the setting process necessary for the base fabric. As a result, fiber bonding may not be optimal.

It is therefore the object of the invention to provide paper machine felts having a high resistance to chemicals, high air permeability and improved wear resistance.

This object is achieved by the postcondensed paper machine felts defined in claim 1 and by the method defined in claim 6. The subclaims contain advantageous embodiments of the invention.

DETAILED DESCRIPTION OF THE INVENTION

Figure 1:
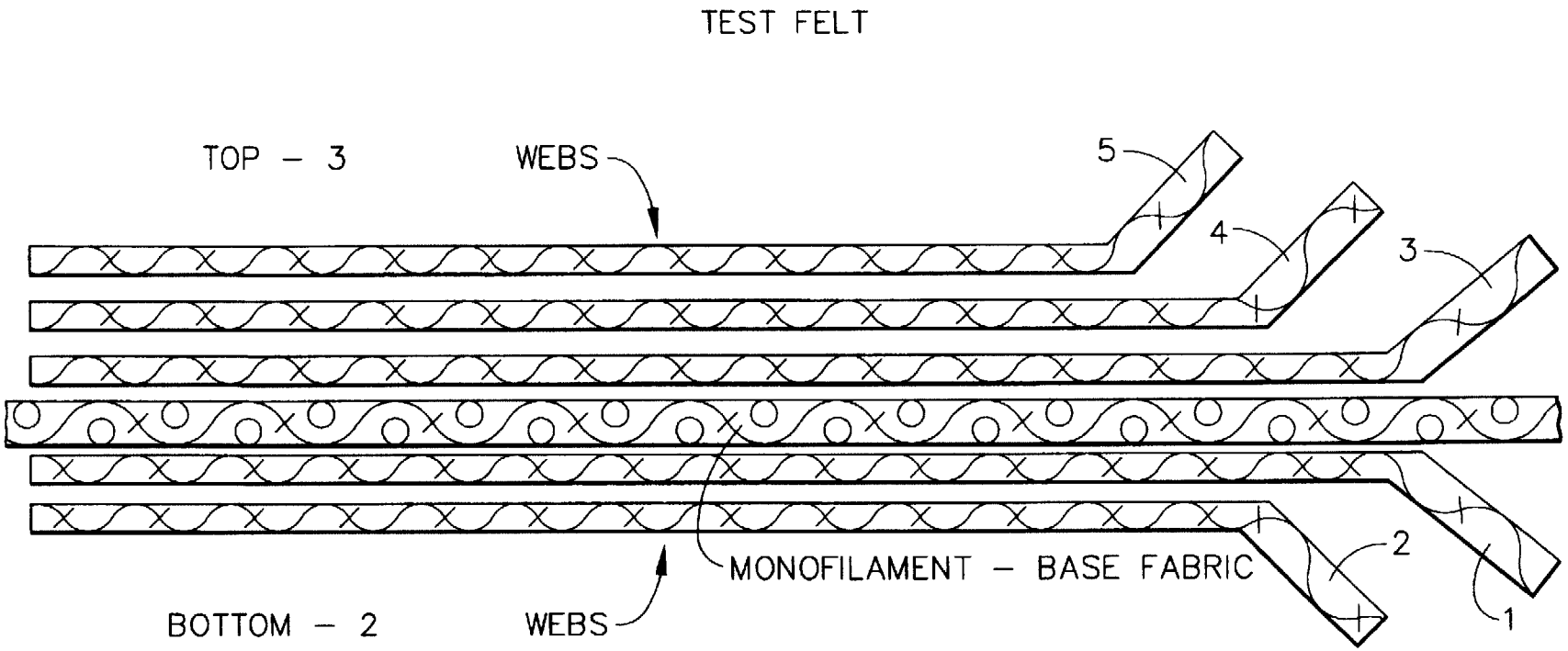
FIG. 1 is a schematic view of the method by which the felts used in the comparative experiments described in the present application were made.

It is not a matter-of-course for someone skilled in the-art that there is a difference in quality between paper machine felts comprising postcondensed fibers as known in the state of the art and postcondensed paper machine felts as defined in the present invention.

Yet, simultaneous postcondensation of the base fabric comprising monofilaments and/or multifilaments is expected to result-in a certain advantage. In general, however, the resistance of the base fabric is not problematic.

However, it has been found that, surprisingly, tests conducted on felt testing presses (see also Table 1 below) revealed significant differences between standard felts and postcondensed paper machine felts as defined in the present invention. When compared to felts comprising postcondensed fibers, the postcondensed felts of the present invention showed a clearly lower change in air permeability, with the final values for both felts being similar, however. This is advantageous in the manufacture of paper because it causes the startup time to be shorter and the felt properties to undergo only slight changes during the startup time.

It has also been a surprising finding that the two felts considerably differed with respect to fiber loss.

On the whole, it has been found that, surprisingly, postcondensed paper machine felts as defined in the present invention will have the required good resistance to chemicals and abrasion if they have a solution viscosity of 5 or more as determined in sulfuric acid at 20° C. (in accordance with the DIN 53,727 standard).

The polyamide fibers of the paper machine felts postcondensed by using the methods of the present invention comprise in particular aliphatic or partly aromatic polyamides or copolyamides, the aliphatic polyamides or copolyamides being based on m-amino carboxylic acids, lactams or aliphatic diamines and aliphatic dicarboxylic acids having 4 to 12 carbon atoms, and the partly aromatic polyamides or copolyamides being based on aliphatic monomers having 4 to 12 carbon atoms. Among them, polyamide 4, polyamide 6, polyamide 11, polyamide 12, polyamide 46, polyamide 66, polyamide 610, polyamide 612, polyamide 1212, polyamide 10T and polyamide 12T are preferred.

Examples of postcondensation catalysts include inorganic phosphorus compounds, preferably salts or esters of phosphoric acid or ortho phosphoric acid, or such acids themselves, with $H_3PO_4$, $H_3PO_3$, $Na_2HPO_4.12H_2O$, $Na_2HPO_3.5H_2O$ and $NaH_2PO_4$ being more preferred. The textile fabrics are impregnated, the content of catalyst of the preferably aqueous solution being no higher than 0.5% by wt., preferably 0.1 to 0.3% by wt., more preferably 0.2% by wt., based on the amount of textiles to be postcondensed. Postcondensation is conducted in an inert gas atmosphere or under vacuum at temperatures between 160° and 200° C., preferably between 170° and 190° C., for 5 to 48 hours, preferably 6 to 24 hours, more preferably 8 to 12 hours.

In a particularly advantageous embodiment of the method of the present invention the textile fabric is postcondensed with aqueous solutions of $H_3PO_4$ or $H_3PO_3$ in amounts of 0.2% by wt., based on the amount of textiles to be postcondensed, at 180° C. under vacuum for 8 hours.

The paper machine felt of the present invention comprising polyamide fibers has a relative solution viscosity, determined as a 1% solution in 98% sulfuric acid (DIN 53,727), of 5 or more, preferably 6 or more, more preferably 6.5 or more, most preferably 7 or more. The polyamide fibers are in particular such comprising m-amino carboxylic acids or lactams having 4 to 12 carbon atoms or such comprising aliphatic diamines and aliphatic dicarboxylic acids having 4 to 12 carbon atoms.

Among them, polyamide 4, polyamide 6, polyamide 11, polyamide 12, polyamide 46, polyamide 66, polyamide 610, polyamide 612 and polyamide 1212 are preferred.

Another embodiment includes partly aromatic polyamides or copolyamides comprising aliphatic monomers having 4 to 12 carbon atoms and aromatic monomers having 6 to 12 carbon atoms, in particular polyamide 10T and polyamide 12T.

A particular advantage of the present invention is the fact that it is possible to first produce textile fabrics from polyamide fibers having low viscosity and being easy to process in a manner known per se without causing fiber damage and then increase their molecular weight by postcondensation to a relative solution viscosity in sulfuric acid of 7 or more, while increasing crystallinity and setting the form of the textile fabrics at the same time.

The following examples illustrate the embodiments of the invention without being limitative.

EXAMPLE 1

Postcondensation of paper machine felts

A piece of paper machine felt of 1×0.5 m in size consisting of a base fabric comprising polyamide 6 monofilaments (nrel=3.4±0.1) and a web needled thereon as a coating comprising polyamide 6 fibers (GrilonR TM26R, nrel=3.4±0.1, determined as a 1% solution in 98% sulfuric acid in accordance with the DIN 53,727 standard at 20° C.) was impregnated with an aqueous solution of phosphoric acid (0.2% by wt., based on the weight of the felt). Upon drying in the air, the felt was postcondensed in a laboratory autoclave under vacuum at 180° C. for 16 hours. The solution viscosity of the resulting postcondensed paper machine felt in sulfuric acid was 10.5±0.5.

EXAMPLE 2

A paper machine felt of 2×0.2 m in size consisting of a base fabric comprising polyamide 6 twists (monofilaments) (nrel=3.4), and a web needled thereon as a coating comprising polyamide 6 fibers (GrilonR TM262R, 17 dtex, 90 mm) was impregnated with an aqueous solution of phosphoric acid (0.24%) in a dyeing autoclave at 98° C. for 30 minutes. Then the felt was dried at 60° C. for 18 hours. Postcondensation was conducted in a vacuum furnace at 180° C. for 16 hours. The analytical data of this sample (sample 2) are shown in Tables 1 and 2.

Comparative Examples

Sample 3 consists of a felt comprising TM262R.

Sample 4 consists of a felt comprising TM262R, with the fibers having been postcondensed (30 minutes, 98° C.; 16 hours, 180° C., vacuum) and the relative viscosity of the fibers being 7.8.

TABLE 2

| Sample | | Fibers | Monofilament gray | Monofilament white |
|---|---|---|---|---|
| 3 | Standard Felt | $\eta_{rel}$ = 3.3 | 3.4 | 3.4 |
| 2 | Postcondensed Felt | $\eta_{rel}$ = 6.6 | 7.3 | 8.11 |
| 4 | Standard Felt Comprising Postcondensed Fibers | $\eta_{rel}$ = 7.8 | 3.4 | 3.4 |

Felt Testing Press

The felts were tested on the FTP-EMS felt testing press.

In the test a sample felt of 2×0.2 m in size was locked in two collet chucks. The collet chucks were connected by a rope beneath the machine and were pulled back and forth during the test. The test comprised the partial steps of pressure test, pressure test including high-pressure showers and abrasion test. In the pressure test the felt was moved back and forth by means of a pair of press rolls (FIG. 2*a*). During the course of the test, the felt was constantly wetted before and after the roll slit. The pressure along a line of the pair of press rolls was adjustable between 0 and 300 kN/m. To measure the compression of the felt, thickness and air permeability were determined after different pressing processes.

Figure 2B:
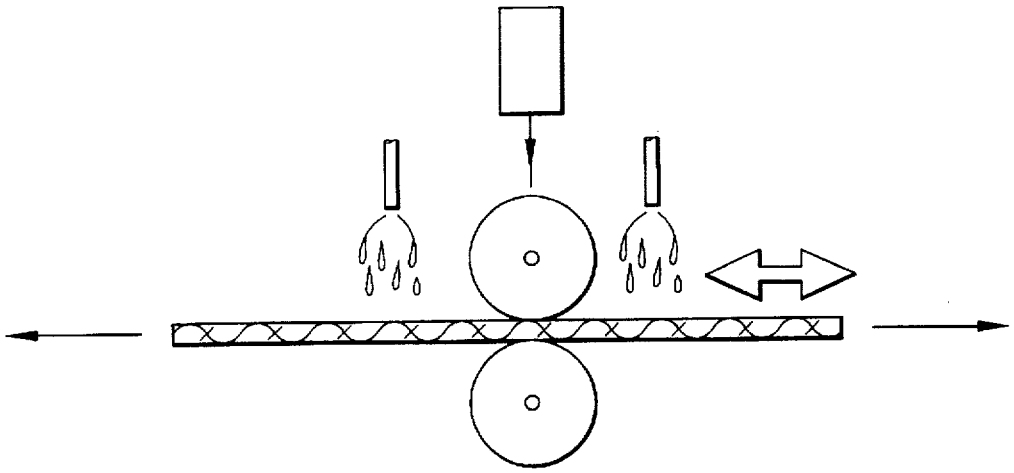
FIG. 2 is a schematic view of the pressure test procedures utilized in the comparative examples described in the present application.
Figure 2B:
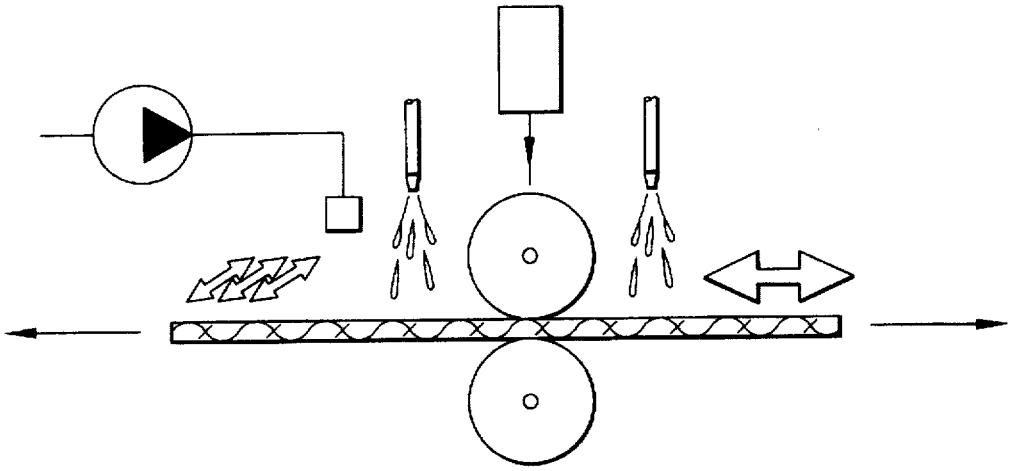

In the pressure test including high-pressure showers (HP showers) the felt was wetted with an oscillating high-pressure shower (water pressure: 40 bars) before and after the roll slit (FIG. 2*b*). The influence of the HP shower was evaluated optically and the fibers that had been removed and collected in a filter were weighed.

Figure 3:
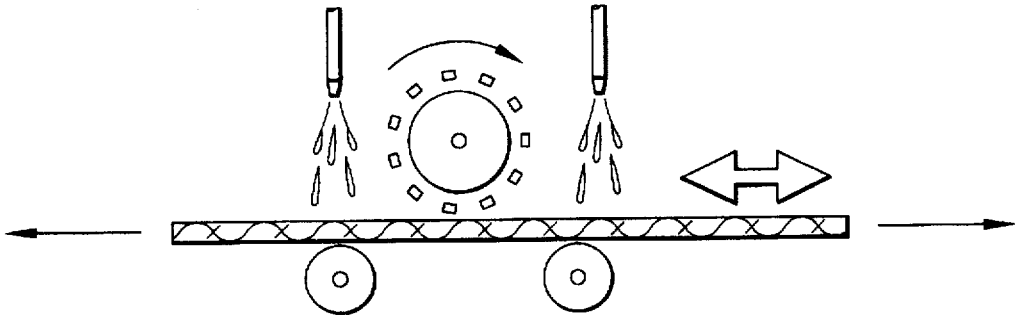
FIG. 3 is a schematic view of the abrasion test used in the comparative examples described in the present application.

In the abrasion test including ceramic bars a ceramic bar imitation roll was used (FIG. 3). Slits were cut crosswise on the roll so that the remaining webs took the form of suction bars. During the test the felt sample was pulled back and forth by the rope control beneath the fast-moving abrasion roll. The resistance of the felts to abrasion was evaluated microscopically and by measuring the amount of worn fibers.

Test Steps

A. washing and setting

B. 100×press rolling (PR) at a pressure along a line of 150 kg/cm

TABLE 1

| | Thickness of Felt | | | Air Permeability | | | |
|---|---|---|---|---|---|---|---|
| Sample | Unset [m/m] | Set | After Testing | Unset [1/m²s] | Set | After Testing | Fiber Loss [g/m²] |
| 2 | 5.13 | 5.19 | 2.86 = 55.1% | 374 | 375 | 53 = 14.1% | 21 |
| 3 | 5.09 | 5.22 | 2.60 = 49.8% | 500 | 418 | 38 = 9.1% | 30 |
| 4 | 5.26 | 5.26 | 2.79 = 53.0% | 502 | 507 | 55 = 9.6% | 26 |

Experimental Conditions

For the experiments, three felts were produced as shown in FIG. 1. Samples 3 and 4 were regarded as standard felts and felt 2 was treated as follows:

The felt was impregnated with a 0.24% acidic solution in a dyeing autoclave at 98° C. for 30 minutes. Then the felt was dried at 60° C. for 18 hours. Postcondensation was conducted in a vacuum furnace at 180° C. for 16 hours (see example 2).

Analysis and Analytical Results

The relative viscosities of the fibers and monofilaments were determined in 1% sulfuric acid.

C. +2700×PR=2800×PR

D. 200×high-pressure showering (HS) using a water pressure of 40 bars and press rolls at a pressure of 150 kg/cm

E. +800×HS=1000 HS

F. 500×abrasion rolling.

Using a sample, treatments A to F were conducted sequentially. Then felt thickness, air permeability and fiber loss were determined and compared to the untreated sample.

Results

Table 1 shows the results of the samples treated with the felt testing press.

The thickness of the postcondensed felt (sample 2) is least-affected by the test. Sample 2 has the largest thickness after the test.

The air permeability of the standard felts (samples 3 and 4) is higher than that of the postcondensed felt (sample 2) both in the unset and set states.

The change in air permeability caused by the treatment in the felt testing press is the lowest in the postcondensed felt (sample 2), that is, sample 2 has the most uniform properties over the entire test period.

At 30 $g/m^2$ (sample 3) and 26 $g/m^2$, the fiber loss of the comparative felts is clearly higher than that of the postcondensed felt (sample 2, 21 $g/m^2$).

What is claimed is:

1. Paper machine felts having decreased in-use fiber loss and decreased in-use change in air permeability comprising a polyamide base fabric and a polyamide coating needled thereon, said base fabric and coating being postcondensed after formation, and said paper machine felts having a relative solution viscosity in sulfuric acid in accordance with the DIN 53,727 standard of 5 or more.

2. Paper machine felts as defined in claim 1 having a relative solution viscosity in sulfuric acid of 7 or more.

3. Paper machine felts as defined in claim 1 wherein the polyamide is an aliphatic polyamide or copolyamide comprising amino carboxylic acids or lactams having 4 to 12 carbon atoms.

4. Paper machine felts as defined in claim 1 wherein the polyamide is an aliphatic polyamide or copolyamide comprising aliphatic diamines and aliphatic dicarboxylic acids having 4 to 12 carbon atoms.

5. Paper machine felts as defined in claim 1 wherein the polyamide is a partly aromatic polyamide or copolyamide comprising aliphatic monomers having 4 to 12 carbon atoms and aromatic monomers having 6 to 12 carbon atoms.

6. A method of increasing the molecular weight of paper machine felts which comprises starting with a non-postcondensed paper machine felt, impregnating said paper machine felt with a solution of postcondensation catalysts, followed by drying and thermally postcondensing the felt below the melting point of the polyamide in a solid phase by the exclusion of oxygen.

7. The method as defined in claim 6 wherein the postcondensation catalysts are inorganic phosphorus compounds.

8. The method as defined in claim 7 wherein the postcondensation catalysts are applied on the paper machine felt in the form of aqueous solutions.

9. The method as defined in claim 7 wherein the amount of catalyst is no higher than 0.5% by wt. based on the amount of paper machine felt to be postcondensed.

10. The method as defined in claim 7 wherein postcondensation is conducted in an inert gas atmosphere or under vacuum at temperatures between 160° and 200° C., preferably 170° and 190° C.

11. The method as defined in claim 7 wherein postcondensation is conducted over a period of 5 to 48 hours.

12. The method as defined in claim 7 wherein the paper machine felt is postcondensed with aqueous solutions of $H_3PO_4$ or $H_3PO_3$, 0.2% by wt., based on the amount of paper machine felt to be postcondensed, at 180° C. under vacuum for 8 hours.

13. Paper machine felts as defined in claim 1 wherein the polyamide is selected from the group consisting of polyamide 4, polyamide 6, polyamide 11, polyamide 12, polyamide 46, polyamide 66, polyamide 610, polyamide 612, polyamide 1212, polyamide 10T, polyamide 12T, and mixtures thereof.

14. The method as defined in claim 7 wherein the postcondensation catalysts are selected from phosphoric acid, ortho phosphoric acid, and salts and esters thereof, and the postcondensation is conducted over a period of 6 to 24 hours.

* * * * *

UNITED STATES PATENT AND TRADEMARK OFFICE

CERTIFICATE OF CORRECTION

PATENT NO. : 5,783,501

DATED : July 21, 1998

INVENTOR(S) : Gustav Schuetze & Jurgen Spindler

It is certified that error appears in the above-indentified patent and that said Letters Patent is hereby corrected as shown below:

On the title page immediately below [56] REFERENCES CITED, please insert --U.S. 5,234,644--

Column 5, line 27 (claim 3), move this line --amino carboxylic acids or lactams having 4 to 12 carbon atoms.--, up on line (line 26) and insert directly behind the word "comprising".

Column 6, line 17 & 18 (claim 10) please delete "preferably 170° and 190° C."

Signed and Sealed this

Twenty-fourth Day of November, 1998

*Attest:*

Bruce Lehman

BRUCE LEHMAN

*Attesting Officer*

*Commissioner of Patents and Trademarks*